United States Patent [19]

Cacciola

[11] 4,165,940

[45] Aug. 28, 1979

[54] FREE FLIGHT HEAD ASSEMBLY FOR DOT MATRIX PRINTERS AND THE LIKE

[75] Inventor: Charles T. Cacciola, East Derry, N.H.

[73] Assignee: Centronics Data Computer Corp., Hudson, N.H.

[21] Appl. No.: 772,459

[22] Filed: Feb. 28, 1977

[51] Int. Cl.[2] ..... B41J 3/12

[52] U.S. Cl. ..... 400/124; 101/93.05

[58] Field of Search ..... 197/1 R; 101/93.05; 335/273, 274; 400/124

[56] References Cited

U.S. PATENT DOCUMENTS

| | | | |
|---|---|---|---|
| 3,929,214 | 12/1975 | Hebert | 197/1 R |
| 3,982,622 | 9/1976 | Bellino et al. | 101/93.34 X |
| 3,993,182 | 11/1976 | Steinke | 197/168 |
| 3,994,381 | 11/1976 | Hebert | 197/1 R |
| 4,004,673 | 1/1977 | Burzlaff et al. | 197/1 R |
| 4,051,941 | 10/1977 | Hebert | 197/1 R |
| 4,053,040 | 10/1977 | McGourty | 197/1 R |
| 4,060,161 | 11/1977 | Nelson et al. | 197/1 R |

*Primary Examiner*—Paul T. Sewell

*Attorney, Agent, or Firm*—Lerner, David, Littenberg & Samuel

[57] ABSTRACT

A print head assembly of the free flight, ballistic type comprising a wire guide subassembly and a solenoid drive assembly adapted to be precisely and adjustably interconnected by means of a novel flexible resilient parasol adapted to simultaneously adjust the spacing between the solenoid assembly armatures and the associated poles without effecting the magnitude of the biasing force imposed forces exerted on the armatures.

23 Claims, 17 Drawing Figures

30
29b
29a'
29a
30f
30a
30g
30h
29
30c
30b
30d
30e
30b-2
30b-1
J
46
48a
48b
47
48
47a
11
W2
W1
T1
T2
A
31

FREE FLIGHT HEAD ASSEMBLY FOR DOT MATRIX PRINTERS AND THE LIKE

BACKGROUND OF THE INVENTION

The present invention relates to impact type dot matrix print heads and more particularly to impact dot matrix print heads of the free flight, ballistic type in which a novel flexible parasol is utilized to permit armature biasing force to be established and maintained independently of the adjustable spacing between the armature and the free flight print wires.

Dot matrix printers are typically comprised of a plurality of print wires whose printing ends are arranged in linear fashion to selectively print dots at dot positions arranged along an imaginary vertical line. A print wire housing is provided for mounting the print wires in a reciprocating fashion so that their forward ends may impact a paper document, typically through an inked ribbon. The rearward ends of the print wires are reciprocally driven by solenoid assemblies selectively energized to cause only those desired print wires to impact the paper document. In order to be assured that the proper amount of driving force will be imparted by each solenoid to its print wire, critical adjustments are typically required. In an effort to simplify the amount and precision of such adjustments, print heads of the type described in U.S. Pat. No. 3,929,214 have been developed which enable the print wire ends to be adjusted relative to the armatures through one single adjustment operation permitting all of the print wires and armatures to be adjusted simultaneously. However, print heads of this type have the drawback of altering the biasing force imposed upon the armature elements whereupon the appropriate positioning between the armature and the print wire results in a biasing force imposed upon each armature.

BRIEF DESCRIPTION OF THE INVENTION

The present invention is characterized by providing a novel, free flight type print head assembly which utilizes a biasing member and flexible resilient parasol enabling adjustment of the positioning of the print wires relative to the solenoids and their armatures without in any way affecting the biasing force imposed upon each of the armatures by the aforesaid biasing member when the armatures are in the rest or impact position.

The novel print head assembly of the present invention is comprised of a nose cone section adapted to slidably mount a plurality of elongated print wires which experience reciprocating movement therein during printing. The nose cone is provided at one end with a jewel bearing assembly which maintains the printing tips of the print wires along an imaginary straight line, which assembly is adapted to provide a very low friction bearing. The opposite (rearward) end of the nose cone is provided with a projection which is slidably and adjustably mounted within a bore provided in a parasol member, the adjustment facilitating spacing between the rearward ends of the print wires extending outwardly through openings provided in the rear wall of the nose cone and armature members cooperating therewith.

A pole plate in the form of a circular disc is secured to a flange provided a spaced distance inwardly from the rear end of the nose cone upon which disc are mounted a plurality of solenoid assemblies each including a U-shaped pole piece, a coil and an armature swingably mounted at a heel portion of the pole piece and adapted to be selectively magnetically attracted to the coil.

The aforementioned parasol member serves as an enclosure for the solenoid assemblies and is provided with a plurality of slots which, together with the natural resilience of the material used to form the parasol member, permits the parasol to freely flex enabling displacement of the central portion thereof relative to the outer lip. The parasol member is provided adjacent its interior and exterior portions with means for aligning and slidably guiding the inner and outer ends of the armatures. The central portion of the parasol member is provided with a recess for seating an energy absorbing O-ring. A biasing spring which is generally of a star wheel design is housed within the concave shaped interior of the parasol member so that alternating radially aligned arms thereof engage shoulders provided at spaced intervals along the parasol member while the remaining interspersed radially aligned arms serve as a means for biasing the heels of the armatures towards their associated pole pieces.

The rearward ends of the print wires are each provided with biasing springs which urge the print wires in the rearward direction and toward and against the inwardly directed tips of the radially aligned armatures. When energized, the armatures are magnetically attracted towards their associated solenoid coils to be rapidly accelerated. The armatures push the heads of their associated print wires imparting kinetic energy thereto. The momentum imparted to the print wires cause them to continue travel even after the armature bottoms. A dot is printed on a paper document by the kinetic energy imparted to the print wire whereupon the elasticity of collision occurring during printing causes the print wire to return after impact, being aided thereby through the biasing spring. During return, the print wire end cap strikes the armature breaking any remnance of the magnetic circuit and imparting movement to the armature in the return direction whereupon both the armature and print wire move toward an energy absorbing O-ring which absorbs the remaining kinetic energy of the print wire and armature and brings these elements to rest. Adjustment of the location of the O-ring relative to the pole pieces may be both readily and accurately performed without in any way affecting the biasing forces imparted to the heels of the armature due to the novel construction of the parasol member and the cooperating pole pieces.

The wire guide housing design facilitates assembly of its components and precisely locates the wire tips relative to a portion of the mounting surface of the housing, greatly facilitating precision alignment of the printed head in a printer.

The solenoid mounting assembly may be used in any applications requiring multiple solenoids and in which gap adjustment is greatly simplified.

OBJECTS AND BRIEF DESCRIPTION OF THE FIGURES

It is therefore one object of the present invention to provide a novel free flight dot matrix print head having a flexible parasol member which serves to provide means for seating an independent biasing spring which biases the heels of the armatures, said parasol being adapted to flex so as to provide for simplified precision adjustment of the positioning of the armature tips without in any way affecting the biasing force applied to the heels of the armatures by said spring.

Another object of the present invention is to provide a free flight print head of the character described hereinabove wherein the free flight arrangement, together with an insulation sheet ("shim") serves to significantly reduce residual magnetism forces in each of the magnetic structures.

Still another object of the present invention is to provide a novel assembly which provides more precise alignment of components as a result of the novel and yet simplified design thereof.

Another object of the invention is to provide a novel mounting assembly for a plurality of solenoids in which the armatures are simultaneously adjustable without changing the biasing forces exerted on the armatures.

The above as well as other objects of the present invention will become apparent when reading the accompanying description and drawings in which:

FIG. 1 shows a side elevational view of a free flight dot matrix print head embodying the principles of the present invention.

FIG. 1*a* shows a front view of the print head of FIG. 1.

FIG. 1*b* shows the rear end view of the print head of FIG. 1 having a portion thereof broken away.

FIG. 1*c* shows a sectional view of the print head of FIGS. 1–1*b* looking in the direction of arrows C-C of FIG. 1*b*.

FIG. 1*d* shows an enlargement of part of FIG. 1*c*.

FIG. 2 shows a top plan view of the nose cone employed in the print head assembly of FIG. 1.

FIGS. 2*a*, 2*b* and 2*c* are sectional views of the nose cone of FIG. 2 looking in the direction of arrows A—A, B—B and C—C, respectively.

FIG. 2*d* shows a rear end view of the nose cone of FIG. 2.

FIG. 2*e* shows a sectional horizontal view of a portion of the housing of FIG. 2.

FIG. 3 shows a sectional view of the parasol of FIGS. 1, 1*b* and 1*c* wherein the parasol is shown in the unflexed position.

FIG. 3*a* shows an interior view of the parasol of FIG. 3.

Figures 5, 5A, 6, 6A:
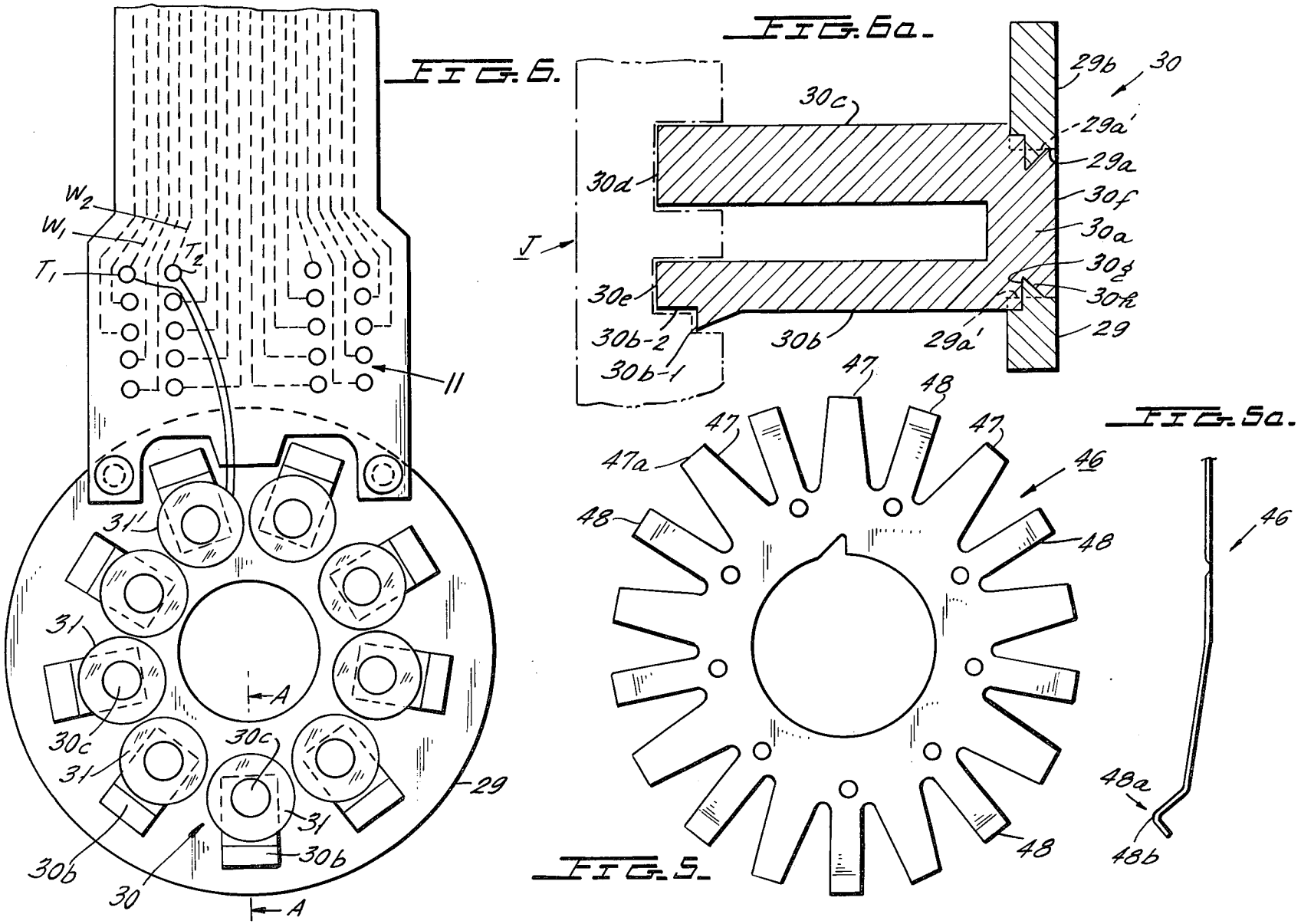
FIG. 5 shows a plan view of the leaf spring assembly employed in the print head.

FIG. 5*a* shows an end view of one typical leaf spring arm adapted to bear against the heel of an associated armature.

Figure 1:
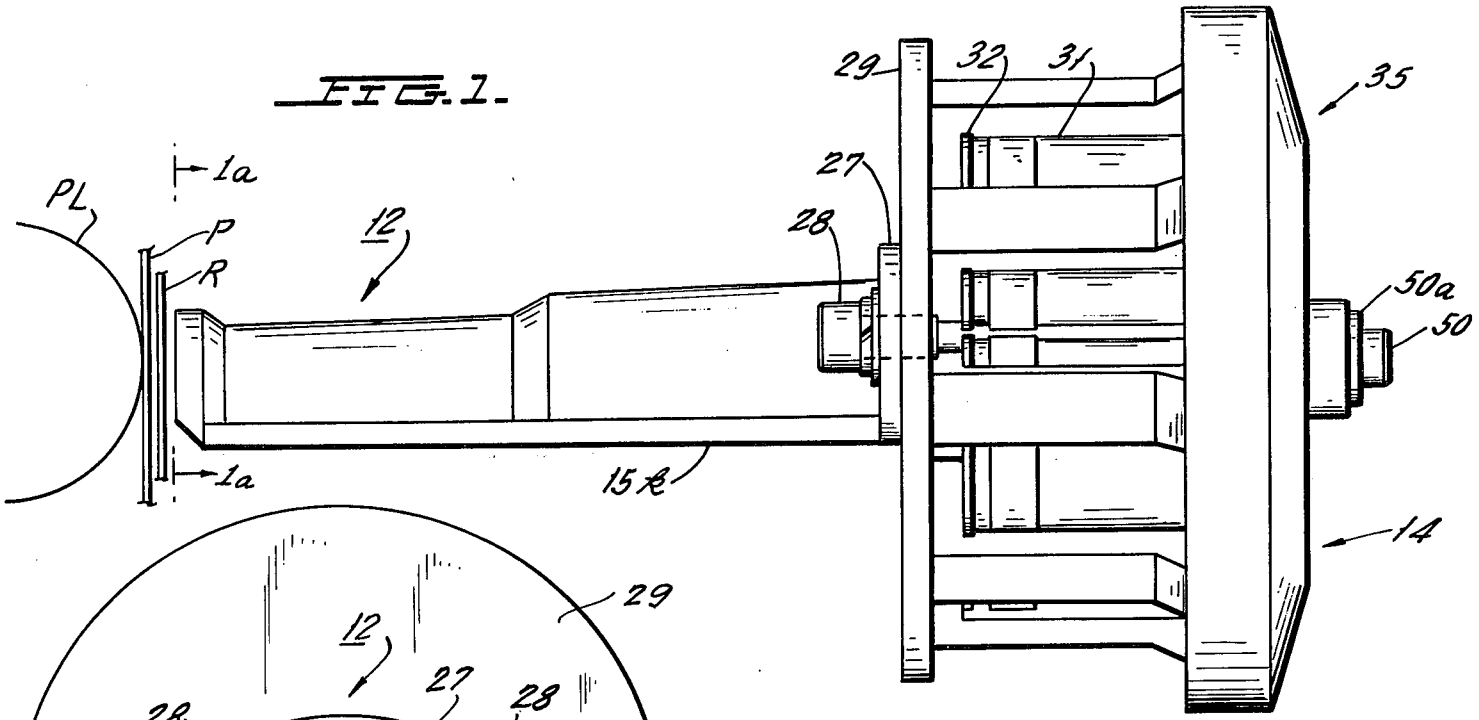

FIG. 6 shows a plan view of the pole plate assembly of FIG. 1.

FIG. 6*a* shows a sectional view of one of the pole pieces of FIG. 6 looking in the direction of arrows 6A—6A.

DETAILED DESCRIPTION OF THE INVENTION

Figure 1A:
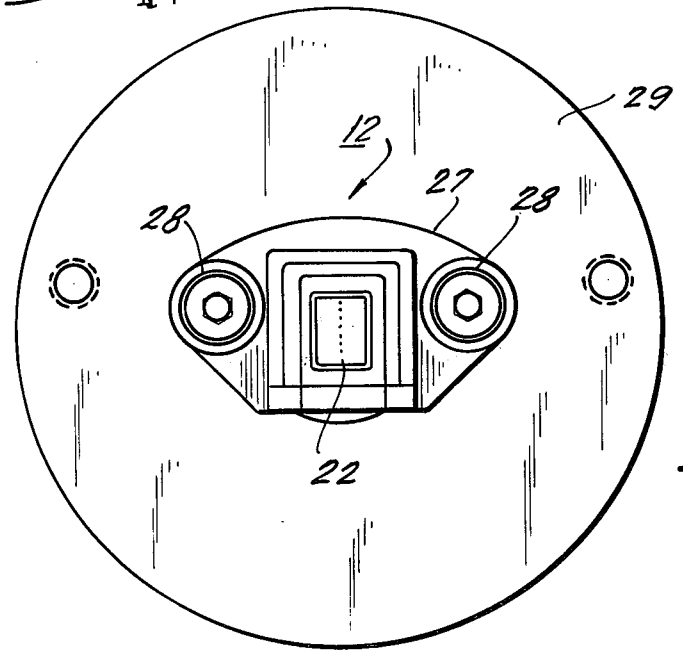
Figures 1B, 1C, 1D:
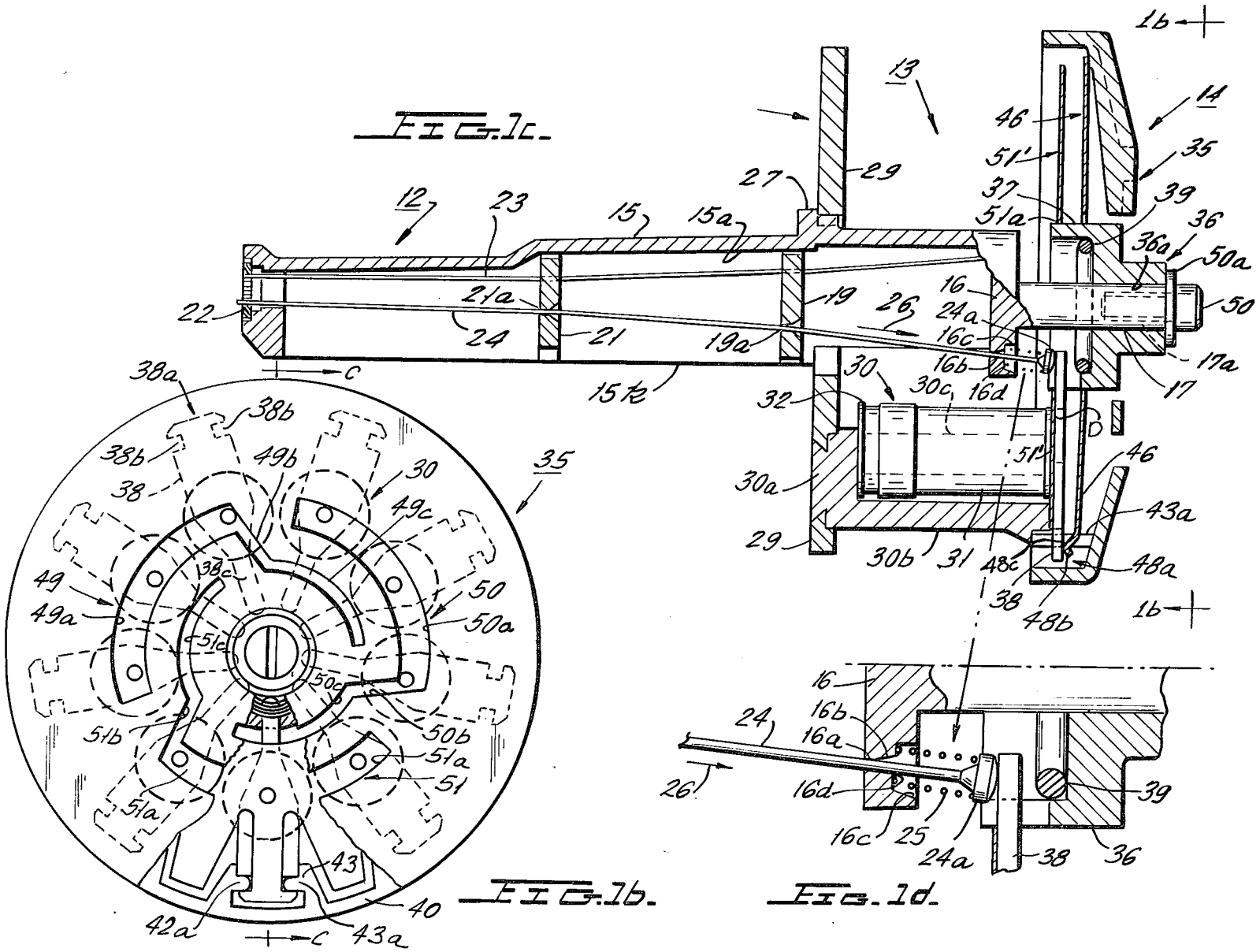

Considering FIGS. 1–1*c*, there is shown therein a print head assembly designed in accordance with the principles of the present invention and which is adapted to be mounted upon a movable carriage and connected to suitable electrical control means (not shown for purposes of simplicity) through the flexible printed circuit member 11 (FIG. 6) for the purpose of selectively energizing solenoids causing the print wires to impact a ribbon R in order to print dots upon a paper document by transfer of the ink to the paper which is supported by a platen $P_L$.

FIG. 1*c* is a sectional view of the free flight print head looking in the direction of arrows C—C of FIG. 1*b* and is comprised of a nose cone assembly 12, a solenoid and pole plate assembly 13 and a parasol and armature biasing assembly 14.

The nose cone assembly is comprised of a one-piece housing 15 open along one side and having a rear wall 16 with a rearwardly extending projection 17 having a threaded aperture 17*a*. The nose cone may be covered by mounting the open side against the surface of the movable carriage (not shown). The bottom surface 15*k* (FIGS. 1, 1*c*, 2*b*) and the left hand edge 15*m* thereof (FIGS. 2, 2*e*) are precisely aligned relative to the print wire tips in a manner to be more fully described to facilitate mounting and alignment upon a printer. The rear wall 16 is provided with a plurality of tapered openings 16*a* which gradually increase in size from the inside rear wall to the outside thereof as shown at 16*b* and further being provided with a large outwardly flaring opening 16*c* arranged to form a shoulder 16*d* between the bore portion 16*b* and the bore portion 16*c*. Only one such opening has been shown in detail (enlarged inset portion of FIG. 1*c*), it being understood that a one of such openings 16*a* are provided for each print wire, as shown best in FIG. 2*d*.

The housing 15 is substantially hollow and has a first pair of support grooves 18*a* and 18*b* arranged on the interior sidewalls thereof and adapted to receive and position the opposite sides of a partition 19 which serves as a guide plate for the print wires as will be more fully described. Partition 19 is provided with double tapered openings 19*a* somewhat similar to those provided in rear wall 16, for receiving each of the print wires. A second pair of support grooves 20*a* and 20*b* are provided downstream of the grooves 18*a* and 18*b* and are designed to receive and position the opposite sides of a second partition 21 having a double tapered openings 21*a* again serving as a guide means for the print wires. The tapered openings serve to facilitate insertion of the print wires and, in both partitions, generally lie along an oval shaped line.

Figures 2, 2A, 2B, 2C, 2D, 2E:
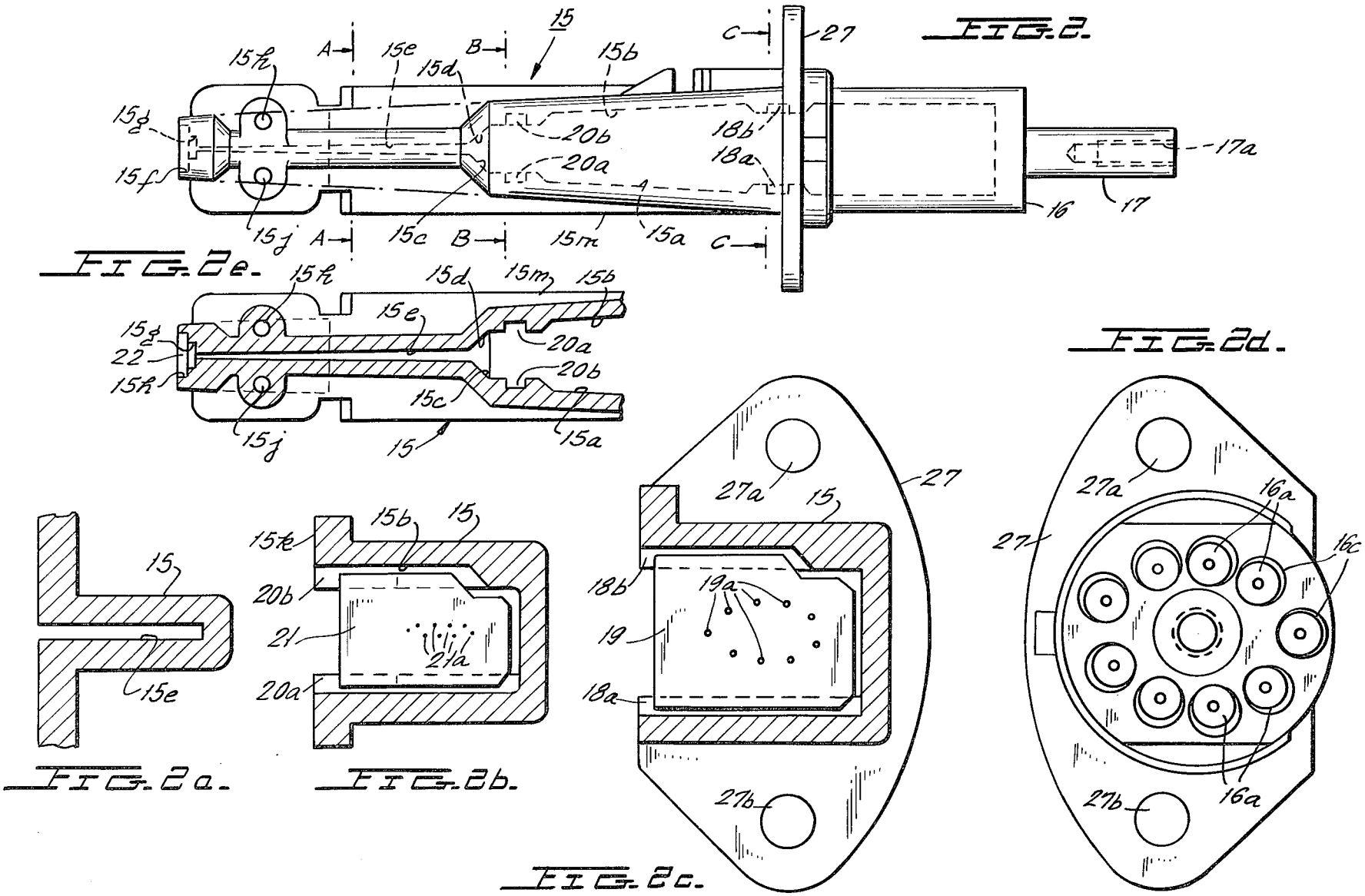

FIGS. 2*b* and 2*c* show the details of these grooves and partitions. It should be noted that the grooves 18*b* and 20*b* are shorter in length than the grooves 18*a* and 20*a*, respectively, and that the partitions 19 and 21 conform to these shapes whereby the shape of the grooves and the conforming shapes of the cooperating sides of the partitions serve to assure proper orientation of the partitions within the grooves. The partitions need not be secured or epoxied into place since they are maintained in place by their cooperating grooves 18*a*, 18*b* and 20*a*, 20*b* and by the print wires 23. Thus, the partitions serve to maintain relative positioning between and among the print wires but do not and need not precisely position the wires relative to the nose cone.

As can be seen from FIG. 2, the interior sidewalls 15*a* and 15*b* of the housing taper very slightly in the region between the pairs of grooves 18*a*–18*b* and 20*a*–20*b*, the sidewalls being substantially parallel in the immediate region of the groove pairs and then tapering quite significantly at 15*c* and 15*d* to form a very narrow passageway at 15*e* which also tapers, but in a gradual fashion, toward the forward or nose end of the nose cone. The V-shaped taper defined by surfaces 15*c*–15*d* facilitates insertion of the print wires into the narrow region 15*e*. The nose is provided with a first recess 15*f* and a second recess 15*g* set within the first recess 15*f* and which is arranged to receive a low friction jewel bearing member 22 provided with a plurality of closely spaced generally circular shaped openings so as to align the forward ends or tips of the print wires along an imaginary straight line in closely spaced fashion enabling a vertically aligned dot pattern to be formed upon the paper document P. The jewel is mounted as follows:

The springs 25 are placed on the print wires. The partitions 19 and 21 are mounted into their guides 18*a*, 18*b*, 20*a*, 20*b*. The wires are inserted through the two openings in rear wall 16 and partitions 19 and 21. As the wires are moved forward, walls 15*c*, 15*d* guide the wires into the narrow guideway 15*e*. The width and length of the slot at the outlet end is about equal to that of the openings in the jewel bearing and serves to maintain the wires in the desired alignment. The precision alignment is sufficient to permit the jewel 22 to be placed in position as aligned by the print wire tips. The jewel is held in place by a suitable adhesive (i.e., epoxy). Thus the alignment of the jewel is automatic. The mold from which the housing is cast is machined to very accurately locate the left hand edge 15*m* and bottom surface 15*k* relative to one another. The plastic material is chosen to provide excellent dimensional stability and low shrinkage. Preferably the material is a filament reinforced plastic material. The opening of 15*e* into the nose may be rectangular as shown, may be separate round openings for each wire, and if desired the openings may be staggered, i.e., arranged to lie along an imaginary path that defines a zig-zag pattern. As shown in FIGS. 2 and 2*e* there is provided a pair of openings 15*h* and 15*j* which receive suitable fastening means (not shown) for securing the nose cone assembly to a carriage assembly which, as is well known in the dot matrix line printer art, serves as the means for moving the print head across the paper document during printing (preferably "on the fly"). The carriage mating surfaces which engage surface 15*k* and edge 15*m* are machined to a similar level of precision to align the carriage thereon.

FIG. 1*c* shows two typical print wires 23 and 24 which can be seen to be maintained in a generally curved condition between the jewel bearing 22 provided in the nose and the partitions 21 and 19 positioned rearward of the jewel bearing 22, as well as the rear wall 16. The print wires are generally of constant diameter over their length and are fitted at their rearward ends with end caps such as, for example, the end cap 24*a* fitted on the rear end of print wire 24. A helical spring 25 has its left-hand end (relative to FIG. 1*c*) seated within opening 16*c* and against shoulder 16*d* and has its opposite end bearing against end cap 24*a*. As can clearly be seen, the helical spring biases each print wire in a direction shown by arrow 26.

The nose cone housing has an integral flange 27 (FIGS. 1*c*, 2 and 2*d*) which flange 27 is provided with a pair of openings 27*a* and 27*b* for receiving the fastening members 28 (see FIGS. 1 and 1*a*) which serve to secure pole plate 29 thereto, pole plate 29 having been referred to hereinabove as part of the solenoid and pole plate assembly 13 and which will be more fully described hereinbelow.

As can best be seen from FIGS. 1*c* and 2, the centrally located projection 17 extending rearwardly from the rear end thereof is designed to be slidably received within an opening provided in the parasol 35, as will be more fully described to accurately align the nose cone and its print wire end caps relative to the armature assembly in a manner to be more fully described hereinbelow.

The pole plate and solenoid assembly is comprised, as was mentioned hereinabove, of pole plate 29, shown best in FIG. 6, the pole plate being a substantially circular disc having a plurality of openings 29*a*, one of which is shown in FIG. 6*a*, each of said openings being adapted to receive a pole piece 30 having a base portion 30*a*, an arm 30*b* of substantially rectangular cross-section and an arm 30*c* of a substantially circular cross-section and extending upwardly from base portion 30*a*, the pole piece having a generally U-shaped configuration. As shown best in FIG. 6, each pole piece has its arm 30*c* of generally circular shaped cross-section arranged to lie closer to the central axis of disc 29 and having its arm 30*b* of generally rectangular shaped cross-section arranged closer to the outer periphery of the disc. As will be noted, each arm 30*b* is provided with a notch having a ledge 30*b*-1 provided for a purpose to be more fully described.

The pole pieces are mounted to the pole plate as follows:

Pole pieces 30 are formed of a metal which is harder than the pole plate 29. The plate 29 is supported on a hard rigid block placed against surface 29*b*. The left hand ends of the pole pieces are inserted in a jig J having precision formed recesses. The opening 29*a* in the plate is initially of a straight-through shape as shown by dotted lines 29*a'* and conforming to the shape of the end face 30*f*. The right hand ends of all of the pole pieces 30 (only one of which is shown in FIG. 6*a*) are simultaneously pressed into their associated openings (see opening 29*a'*) causing the shoulders 30*g* forming one surface of V-shaped indentations 30*h* to cause a "cold flow" of the metallic material of plate 29 into the indentations as a result of displacement of the metal by shoulder 30*g*, resulting in the final shape 29*a*. The soft plate compensates for any possible differences in the lengths of the pole pieces so that the left hand ends of the pole pieces are all accurately aligned with their faces 30*d* and 30*e* coplanar. The conforming shapes of the end face 30*f* and openings 29*a* assure proper alignment of each pole piece 30 in plate 29.

Each arm 30*c* is adapted to receive a solenoid coil 31 wound upon a bobbin 32 having a circular shaped bore and which is fitted upon the arm 30*c*. The wires of each coil are led out to an associated terminal provided on the flexible circuit element 11, the connection of two such wires for the solenoid 31' (wires W1 and W2) being shown as connected to the terminals T1 and T2 on the flexible circuit element 11.

Although the armatures can clearly be said to be part of the solenoid assemblies, the manner in which they are mounted and the manner in which they function will be described after first considering the parasol and armature biasing assembly 14.

The parasol and armature biasing assembly is comprised of a parasol member 35 having a central portion 36 and an outer annular portion. Considering FIGS. 3 and 3*a*, the central hub portion 36 is provided with an opening 36*a* for receiving projection 17 of the nose cone housing in the manner shown, for example, in FIG. 1*c*. The central portion, as can best be seen in FIG. 3*a*, has a substantially oval or elliptical shaped flange 37 provided with a plurality of slots 37*a* at spaced intervals therearound and each adapted to slidably receive the forward end of an associated armature element 38 which, from a consideration of FIG. 1*b*, can be seen to be comprised of a heel portion or outer end 38a having a pair of notches 38b, 38b and tapers to form a tip portion or inner end 38c of reduced width, which tip portion is slidably received within one of the aforementioned slots 37a.

The inner wall 37b of oval shaped flange 37 receives an energy absorbing resilient compressible O-ring 39 which is force-fittingly received therein and is adapted to absorb kinetic energy from the armatures in a manner to be more fully described.

The outer portion of parasol 35 is provided with an oval shaped continuous flange or outer peripheral ring or annular projection 40, whose major diameter is just slightly greater than its minor diameter, and having a plurality of pairs of projections 41, one such pair being comprised of a first projection 42 and a second projection 43, each projecting inwardly from flange 40 and each provided with transversely aligned armature locating flanges 42a and 43a extending toward one another and having semicircular or rounded free ends or tips which are adapted to be slidably inserted within the notches 38b, 38b of an associated armature, as shown best, for example, in FIG. 1b. A similar pair of flanges is provided for each armature.

Positioned between projections of adjacent pairs, for example, pairs 41 and 41' and between pairs 41 and 41'', there is provided a ledge or step 44 and 45 respectively, each being adapted to serve as a seat for one of the flat fingers of leaf spring 46. Considering FIGS. 1b, 5 and 5a, the leaf spring 46 can be seen to be comprised of a plurality of fingers 47 each having a tapered shape, being wider at its inner end and narrower at its free end 47a, for example. Interspersed between each of the fingers 47 are fingers 48 which, as can best be seen from FIG. 5a, is provided with a substantially V-shaped bend 48a so that the knee 48b of the V-shaped bend is positioned to rest upon the heel portion of an associated armature as can best be seen in FIG. 1c wherein knee 48b is shown as resting upon the heel portion 38a, which heel portion is immediately behind the pair of notches 38b, 38b.

Figure 3:
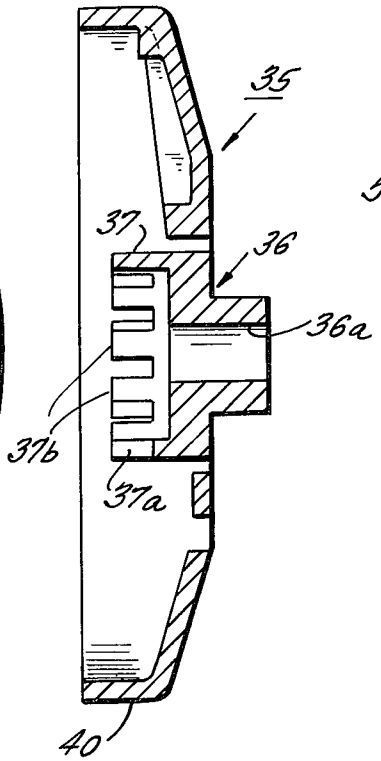
Figure 3A:
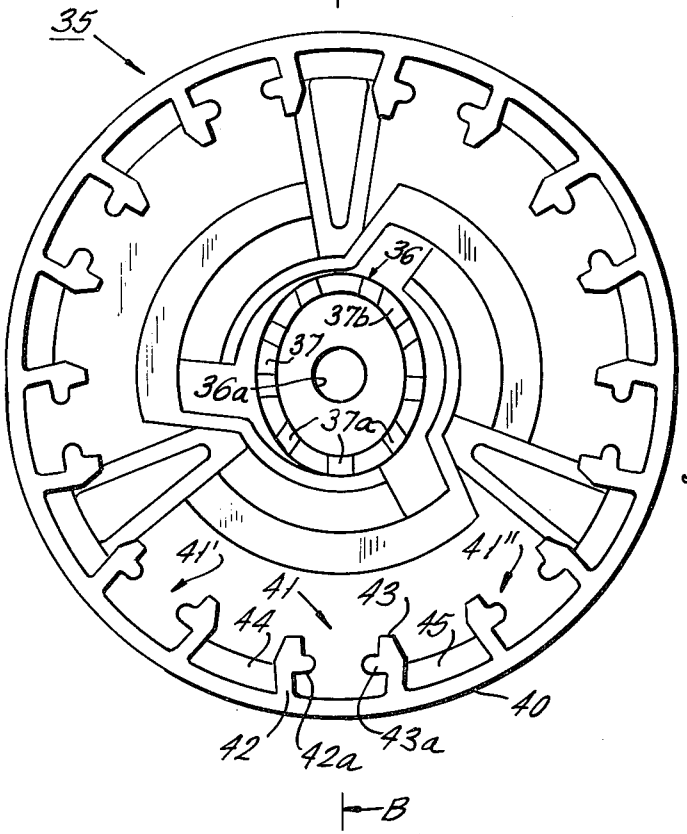

The parasol is provided with a plurality of flexure slots 49, 50 and 51, each of which is comprised of an outer arcuate shaped slot 49a, 50a and 51a, an inner arcuate shaped slot 49c, 50c and 51c and a diagonally aligned intermediate and substantially linear slot 49b, 50b and 51b with the intermediate slots joining the inner and outer slot portions in the manner shown best in FIG. 1b so as to cooperatively form three substantially similar shaped slot arrangements. The parasol is formed of a suitable plastic material which inherently has a high degree of natural resiliency. This fact further coupled with the slot arrangements as shown in FIG. 1b permits the portion of the parasol between the central ring portion 36 and the outer ring portion 40 to be adapted to flex. The nature of the flexure may best be understood from a consideration of FIGS. 3 and 1c wherein FIG. 3 shows the parasol assembly 35 in its unflexed condition. When assembling the parasol into the print head, the O-ring 39 is mounted in the manner shown in FIG. 1c. Thereafter, the leaf spring is positioned within the concave interior portion of the parasol so that the free ends of each of the tapered fingers 47 rest upon an associated ledge (see ledges 44 and 45, for example) and so that the remaining interspersed fingers 48 are positioned between each associated pair of guide projections. The armatures are then positioned upon the leaf spring so that each pair of slots 38b, 38b are positioned between a pair of guide projections 41 and so that the slots are received by projections 42a and 43a, for example, (see FIG. 3a).

After this subassembly is completed, the parasol, together with the O-ring and leaf spring and armature elements, is positioned so as to receive the projection 17 within central opening 36a. The angular orientation of the nose cone relative to the parasol is such as to position the tip 38c of each armature immediately above and in fact upon a head 24a of one of the print wires. Note especially FIGS. 1b and 1c in this regard. As can best be seen from FIG. 1c, the projections 42a and 43a, for example, rest upon a shoulder 30b-1 (see FIGS. 1c and 6a) provided in the arm 30b of each U-shaped pole piece so that the location of the outer ring 40 of the parasol is fixed relative to the pole pieces. The oval shape of ring 37 and the similar oval arrangement of openings in the guide plates 19 and 21 greatly reduce the amount of curvature imparted to each print wire in bringing the wires into the desired linear alignment at the bearing 22.

The fastening member 50 is then threaded into the threaded aperture 17a provided in projection 17 and is tightened or otherwise adjusted so as to adjust the gap or displacement D between the confronting end faces 30d of pole piece arms 30c and the adjacent surface of the tip 38c of each armature 38. Helical springs 25 serve to urge each armature tip against O-ring 39. It can further be seen that the biasing force exerted upon the heel of each armature element is totally independent of the adjustment of the central portion 36 of parasol 35 regardless of the actual positioning of the central portion. The adjustment is facilitated by the natural resiliency of the material from which the parasol is formed together with the aforementioned slot arrangements 49, 50 and 51 shown, for example, in FIG. 1b, FIG. 1c clearly showing the amount of flexure experienced by the parasol 35 as a result of appropriate adjustment, to thereby simultaneously adjust the air gaps of all of the solenoid assemblies.

Figure 4:
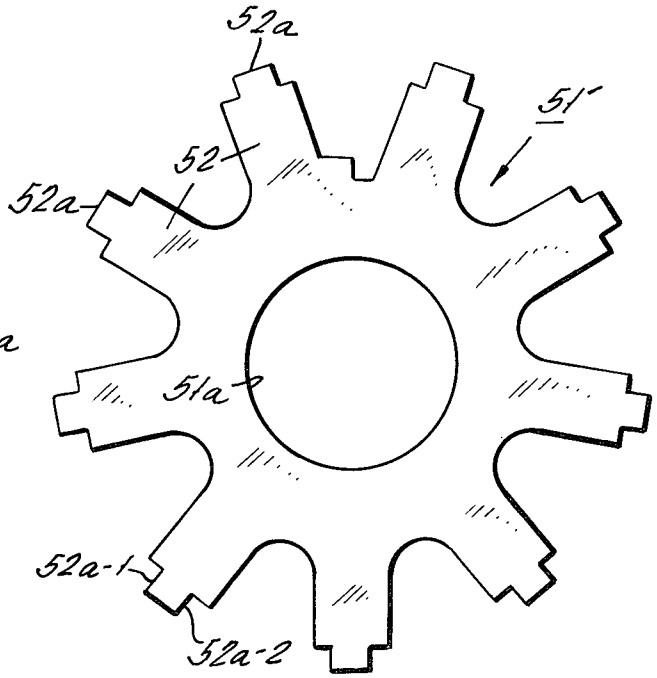
FIG. 4 shows a plan view of the shim employed in the print head assembly as shown in FIG. 1*c*.

In addition to the above arrangement, there is provided a shim 51' as shown, for example, in FIGS. 1b and 4, which is formed of a suitable insulation material, said shim being provided with a plurality of radially aligned fingers 52 each having a portion 52a of reduced width at its extremity due to the notched corners 52a-1 and 52a-2. The central portion of the shim is provided with an opening 51a to receive the central ring projection 37 of parasol 35 (note FIG. 3a). The diameter of opening 51a is at least equal to the major diameter of the oval shaped ring 37 so as to be positioned at any angular position relative to the oval shaped projection. However, each of the fingers 52 are positioned so as to be in alignment with each armature 38. The notched free ends 52a are adapted to be positioned between each pair of inwardly directed transversely aligned projections 42a and 43a (see FIG. 3a) so as to permit each reduced width portion 52a to be sandwiched between the heel 38b of the armature and the free end face 30e of pole piece 30b (see FIG. 5). From a consideration of FIG. 1b, it can be seen that each finger of the shim is also positioned between the end face 30d of each pole piece (see FIG. 5a) and the associated armature 38. This shim thereby provides a bearing surface at the pivot of each armature, i.e., where corner 30b-2 is located (see FIG. 6a) and also provides a sacrificial material such that the shim may be removed and readily replaced when worn while at the same time minimizing any wearing of the armatures and pole pieces. In addition thereto, the shim cushions the impact of the armature against the pole 30*d* during operation, as will be more fully described and further, due to its insulation nature, minimizes remnance (i.e., residual magnetism) during operation. Also, during impact, the shim minimizes any metal distortion caused by the impact of the armature upon the pole piece. The minimum air gap provided by the shim also lessens the magnetomotive force caused by remnance of the magnetic circuit.

The operation of the novel structure of the present invention is as follows:

Dependent upon the particular dots to be printed, certain of the coils 31 are energized. However, prior to energization, the armatures are maintained a spaced distance from the end faces of their associated pole pieces 30*c* as a result of the helical springs 25 which urge the heads 24*a* of the print wires 24 rearwardly thereby urging the tips of the armatures rearwardly and against O-ring 39.

Upon energization of the coil (or coils), the magnetic flux developed exerts an attractive force upon the associated armature causing the armature to be drawn toward the associated pole piece. The fingers 48 of spring 46 have their knees 48*c* bearing down upon the heels of the armatures and thereby serve to cause the armature heels to bear against the pivotal mount provided by pole piece arm 30*b*. As the armatures are accelerated in moving toward their associated solenoid coils, they develop kinetic energy, which kinetic energy is also imparted to the print wire as each actuated armature tip is accelerated, thereby causing the print wire to move together with and in the same direction as its associated armature tip. The momentum of the print wire causes it to continue to travel in the print direction even after the armature bottoms, i.e. impacts against the face 30*d* of pole piece 30*c* (see FIG. 5*a*). The print wire is now in free flight.

A dot is printed by the kinetic energy imparted to the print wire as a result of the print wire impacting against the ribbon R and paper document P supported by a suitable backing surface or platen $P_L$.

The elasticity of the collision during the printing operation causes the print wire to return, the solenoid coil having been deenergized either at or prior to this time. The return of the print wire is aided by the associated helical spring 25. The cap or button 24*a* strikes the armature tip 38*c*. In the event that residual magnetism serves to maintain the armature attracted to the pole piece, the kinetic energy imparted to the armature is used to break the remnance of the magnetic circuit and thereby start the armature in motion in the rearward direction. The armature and print wire both move toward O-ring 39 which absorbs the remaining kinetic energy of the print wire 24 and armature 38 so as to rapidly return the print wire and armature tips to the rest condition in readiness for the next operation. The leaf spring arms 48 serve to maintain the heel of each armature against its associated pole piece as well as serving to urge the tip away from pole piece arm 30*a* when each solenoid coil is deenergized.

The solenoid mounting assembly 13 may be employed in any applications which employ a plurality of solenoids. The armatures may be utilized to drive members other than print wires while retaining the advantages of ease of adjustment of the gaps of the armature tips and their associated pole pieces. If desired the biasing forces of the individual fingers may be independently controlled by altering the depths of the ledges 45 (FIG. 3*a*) as well as the bases of slots 37*c* for independently adjusting the gaps between the armature tips and their associated pole pieces.

It can be seen from the foregoing description that the present invention provides a novel arrangement in which the force imparted to the heel of each armature is constant and remains constant regardless of the relative and adjustable positioning of the central portion 37 of the parasol member 35 relative to the print wire and the caps 24*a*. Each of the pole pieces positively position outer ring 40 of the parasol member without the need for any adjustment whatsoever. The design of the components is such as to greatly facilitate both assembly and disassembly and the nature of the components is such as to be inexpensive and yet provide tight tolerances therefor.

What is claimed is:

1. A print head of the dot matrix type comprising:

a nose cone assembly for slidably mounting a plurality of elongated print wires, said nose cone assembly having means at the forward end for maintaining the forward ends of the print wires in closely spaced fashion and along an imaginary straight line;

the rear end of said nose cone having openings through which the rearward ends of the wires protrude;

a pole plate surrounding the nose cone and secured thereto at a point inward from the rear end thereof;

a plurality of wire actuating means having solenoid coil assemblies mounted at spaced intervals around the pole plate and having armatures whose inner ends each overlie the rearward end of an associated print wire;

a resilient parasol shaped member connected to said nose cone assembly and having a generally concave interior provided with a central hub and an outer peripheral ring including guide slots for receiving and aligning the inner and outer ends of said armatures;

a biasing spring member having a plurality of spaced-apart radially extending armature biasing fingers each arranged to apply a biasing force upon the outer end of an associated armature to urge the outer ends of said armatures toward their associated solenoid coil assemblies;

said outer peripheral ring including means for urging said biasing fingers towards the outer ends of their associated armatures;

means for adjusting the axial position of said central hub relative to said armatures to adjust the air gaps of said solenoid coil assemblies without affecting the magnitude of said biasing force which the outer peripheral ring of the parasol exerts upon the outer ends of said armatures through said biasing fingers.

2. The print head of claim 1 wherein said solenoid assemblies further comprise a pole piece and a solenoid coil, said armature overlying a first end of said coil and said pole piece;

a thin sheet of insulation material positioned between each armature and the first ends of the associated pole pieces and coils to minimize residual magnetism and serve as a bearing material at the pivot of each armature and for cushioning the impact of each armature during energization.

3. The print head of claim 1 wherein said print wires further comprise an enlarged head at the rearward end;

spring means positioned between each print wire head and the rear end of said nose cone for normally urging said print wires in the rearward direction.

4. The print head of claim 1 wherein said parasol is a generally dome shaped member having a plurality of generally spiral shaped slots to facilitate flexure of the intermediate portion thereof.

5. The print head of claim 1 wherein each solenoid assembly comprises a U-shaped pole piece having a yoke portion and first and second arms;

a solenoid coil positioned about each of said first arms;

said armature being comprised of a flat member having a generally tapered shape, the wide end being positioned upon the end face of said second arm and the narrow end being positioned upon the end face of said first arm;

said outer ring having a plurality of pairs of inwardly directed guide flanges;

said armatures having a pair of slots arranged along opposite sides of said wide end slidably receiving said guide flanges;

said pole piece second arm having a shoulder displaced inwardly from its end face whereby each pair of flanges is adapted to rest upon one of said shoulders.

6. The print head of claim 1 wherein said central hub is oval shaped and is provided with slots each adapted to slidably receive the inner end of an armature;

said nose cone having a plurality of guide plates arranged at spaced intervals within said nose cone and being provided with openings adapted to slidably receive a print wire;

said guide plate openings and the openings in the rear end of the nose cone each being arranged along an imaginary line generally defining an oval shape, the oval shapes each being progressively smaller, the closer they are to the forward end of the nose cone.

7. A print head of the dot matrix type comprising:

a nose cone assembly for slidably mounting a plurality of elongated print wires, said nose cone having means at the forward end for maintaining the forward ends of the print wires in closely spaced fashion and along an imaginary straight line;

the rear end of said nose cone assembly having openings through which the rearward ends of the wires protrude;

a pole plate surrounding the nose cone and secured thereto at a point inward from the rear end thereof;

a plurality of wire actuating means having solenoid coil assemblies each including a pole piece and mounted at spaced intervals around the pole plate and having armatures whose inner ends each overlie the rearward end of an associated print wire;

a resilient parasol shaped member connected to said nose cone assembly and having a generally concave interior provided with a central hub and an outer peripheral ring for receiving and aligning the inner and outer ends of said armatures;

a biasing spring member having a portion thereof engaging said parasol member and having a plurality of spaced-apart radially extending armature biasing fingers each arranged to apply a biasing force upon the outer end of an associated armature to urge the outer ends of said armature against its associated pole piece;

said peripheral ring having a portion thereof engaging said pole pieces to thereby establish the magnitude of said biasing force exerted by said armature biasing fingers upon their armatures;

means for adjusting the axial position of said central hub relative to said armatures to adjust the air gaps of said solenoid coil assemblies without affecting the magnitude of said biasing force which the outer peripheral ring of the parasol exerts upon the outer ends of said armatures through said biasing fingers.

8. The print head of claim 7 wherein said solenoid assemblies are each comprised of a U-shaped pole piece having first and second arms, a solenoid coil wound about said first arm of said pole piece and a flat armature member cooperating with the end faces of the arms of said pole piece;

the second arm having a shoulder spaced inwardly from its end face;

said armature having slots adjacent the end overlying said second arm; said parasol member outer ring having projections slidably engaging said armature slots and resting upon each of said shoulders of said pole pieces to thereby positively and precisely locate said outer ring relative to said pole pieces.

9. A solenoid mounting assembly comprising:

a pole plate;

a plurality of solenoids each having a pole piece and a coil surrounding each pole piece, and an armature positioned above each pole piece;

one end of each pole piece being secured to said plate;

a parasol shaped member having a generally concave interior and being provided with generally spiral shaped slots intermediate its central and outer portions;

the concave surface of said central portion having slots for slidably receiving the inner ends of said armatures;

the concave side of said outer portion having an annular projection for slidably receiving the outer ends of said armatures;

a flat biasing member positioned between said parasol member and said armatures for engaging said armatures;

means for adjustably positioning the parasol member central portion an adjustably spaced distance from said plate for simultaneously controlling the distance which the inner ends of all of the armatures may be displaced from their pole pieces.

10. A print wire housing for use in dot matrix printers and the like comprising an elongated body having a rearward end and a foward end; said body having a cavity extending between said ends for receiving and guiding the print wires;

the rearward end having openings for receiving print wires therethrough;

the rearward and forward portion of said cavity each providing wire guideways of differing dimensions;

the forward guideway being smaller than the rear guideway;

an intermediate portion of said cavity forming an intermediate guideway joining said front and rear guideways and having a taper narrowing from the rearward guideway towards the forward guideway to facilitate insertion of the print wires from the rearward end through the rearward and intermediate guideways and into the forward guideway; said intermediate guideway having a taper at a substantially greater angle than said forward and rearward guideways; the walls forming the taper of said intermediate guideway being engaged by the forward tips of said print wires upon their initial insertion into said print wire housing;

at least the forward end of the forward guideway having a through opening extending through to the forward end face of the housing, said opening being in the form of an elongated slot whose width is nearly equal to the diameter of a print wire and whose height is greater than the sum of the diameters of the total number of print wires accommodated by the housing.

11. The housing assembly of claim 10, further comprising a jewel bearing fixedly secured to the front face of said housing and cooperating with the opening in said front face for maintaining the print wires in a predetermined alignment.

12. The housing assembly of claim 10 wherein at least portions of the bottom and one side edge of the housing are formed so as to have a predetermined and accurate location relative to said front face opening to facilitate simplified and accurate positioning of the housing assembly within a printer.

13. The housing assembly of claim 10 wherein said housing is formed of a material which has the characteristics, excellent dimensional stability, and low shrinkage.

14. The housing assembly of claim 13 wherein said material is a filament reinforced plastic material.

15. The print head of claim 1 wherein said spring member further includes a plurality of fingers interspersed with said armature biasing fingers engaging said outer peripheral ring to urge said interspersed fingers and said armature biasing fingers towards said armatures.

16. The print head of claim 1 further including resilient means for absorbing energy from the inner ends of said armatures impacting upon said resilient means.

17. The print head of claim 7 further including resilient means for absorbing energy from the inner ends of said armatures impacting upon said resilient means.

18. A print head of the dot matrix type including a plurality of elongated print wires, a nose cone assembly in which said print wires are slidably mounted, a bearing at the front end of said nose cone assembly through which the printing ends of said print wires protrude, openings in the rear end of said nose cone assembly through which the driving ends of said print wires protrude, a plurality of solenoid assemblies each including an armature and a pole piece disposed about the rear end of said nose cone assembly, each solenoid assembly being operatively associated with one of the print wires, an inner end of each armature being operatively associated with the driving end of its associated print wire for selectively causing it to perform a printing operation, an armature support and biasing assembly for receiving said armatures comprising a flexible, parasol-shaped member and a biasing spring member mounted in said flexible, parasol-shaped member, said flexible, parasol-shaped member comprising a central hub portion and an outer annular portion, said spring member having a plurality of spaced-apart radially-extending armature biasing fingers, an end portion of each of said fingers applying a biasing force to an outer end of its associated armature for urging said inner end of its associated armature away from its associated pole piece, an adjustable mounting means connecting said central hub portion of said flexible, parasol-shaped member to the rear end of said nose cone assembly for adjustably positioning said central hub portion at a desired position relative to the inner ends of said armatures to adjust the air gap between each armature and its associated pole piece without affecting the magnitude of the biasing force which the outer annular portion of the parasol exerts upon the outer ends of each armature through said biasing fingers.

19. A print head according to claim 18 wherein said armature support and biasing assembly further comprises a thin insulating shim member including a portion disposed between each said armature and its associated pole piece arms to provide a bearing surface for each armature and to provide a minimum air gap between each said armature and its associated solenoid to lessen the magnetomotive force caused by remnance of the magnetic circuit thereof.

20. A print head according to claim 18 wherein said bearing at the front end of said nose cone assembly comprises openings for slidably receiving the print wires, and said nose cone assembly further comprises slots for sliably receiving movable guide plates, said guide plates each including holes for receiving said print wires, and a guide slot for receiving and guiding said print wires, said print wires interacting with said guide slot and with said holes in said movable guide plates and with the said openings in the rear end of said nose cone assembly to position and align said movable guide plates in a desired orientation.

21. The print head of claim 18 wherein said spring member further includes a plurality of fingers interspersed with said armature biasing fingers and cooperating with said annular portion of said parasol member to apply said biasing force to said armatures.

22. The print head of claim 18 wherein each of said pole pieces includes stop means cooperating with said annular portion of said parasol member to positively position said annular portion relative to said pole pieces and to prevent movement of said annular portion when said central hub portion is adjusted.

23. A print head according to claim 18 wherein said armature support and biasing assembly further comprises a thin insulating shim member including a portion disposed against each armature to provide a bearing surface to reduce wear.

* * * * *